United States Patent [19]

Fairchild

[11] 4,336,911

[45] Jun. 29, 1982

[54] FRICTIONAL TENSIONING DEVICE

[76] Inventor: Wayne K. Fairchild, 3620 W. Pendleton Ave., Santa Ana, Calif. 92704

[21] Appl. No.: 189,153

[22] Filed: Sep. 22, 1980

[51] Int. Cl.[3] ..... B65H 23/06; B65H 59/16

[52] U.S. Cl. ..... 242/75.4; 242/156

[58] Field of Search ..... 242/75.4, 75.43, 75.44, 242/75.47, 156, 75.2, 75; 226/39, 195

[56] References Cited

U.S. PATENT DOCUMENTS

| | | | |
|---|---|---|---|
| 1,340,710 | 5/1920 | Graham | 242/75.4 |
| 1,364,259 | 1/1921 | Eaton | 242/156 |
| 1,640,760 | 8/1927 | Emery | 242/156 |
| 2,428,333 | 9/1947 | Lessler | 242/75.4 X |

*Primary Examiner*—Edward J. McCarthy
*Attorney, Agent, or Firm*—Francis X. LoJacono

[57] ABSTRACT

A frictional tensioning device for use in dispensing a continuous spool of ribbon or tape material under a uniform tension, regardless of the changing diameter of the spool. The device comprises a mounting pin secured to a fixed structure or base plate, the pin extending upwardly through an intermediate resilient base member having a sheet member of very low friction defining a layer disposed on the outer surface of the resilient base member, on which is positioned a thin flexible plate interposed between the frictional sheet member and the spool of tape material, so as to allow the spool and the flexible plate to rotate together about the pin under a controlled compressionable force provided by a spring-biased hub member mounted to the pin and held in the central core of the spool by a nut and a spring, thus establishing a means to apply the required compression on a given type of tape or ribbon being dispensed therefrom.

8 Claims, 3 Drawing Figures

FIG. 1
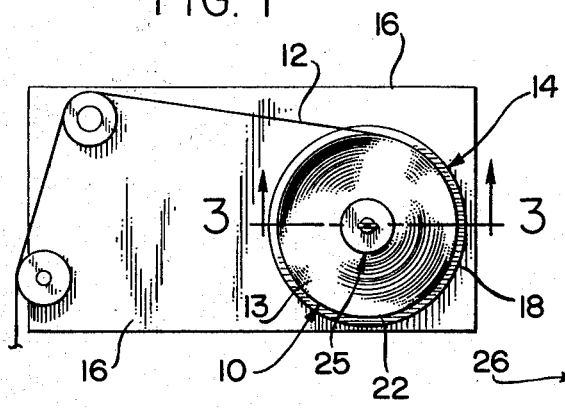
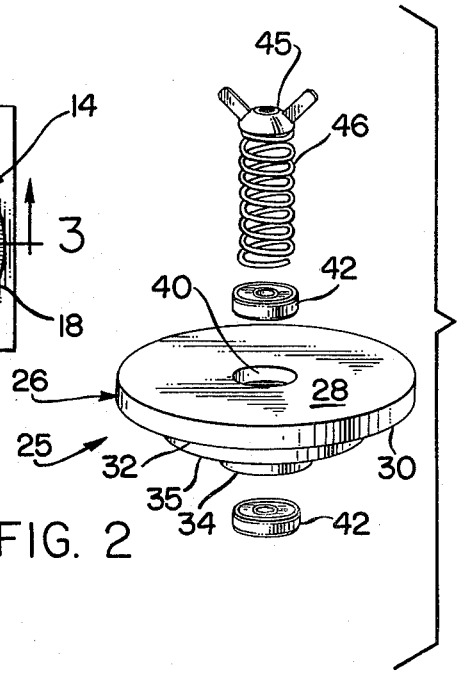
FIG. 2
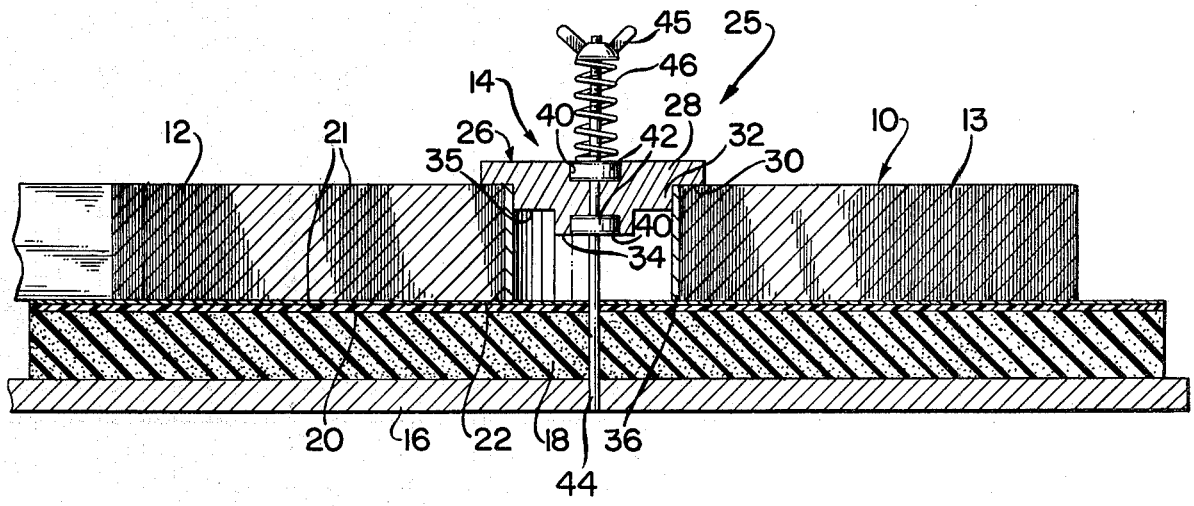
FIG. 3

FRICTIONAL TENSIONING DEVICE

BACKGROUND OF THE INVENTION

1. Field of the Invention

This invention relates generally to a tensioning device, and more particularly to a tensioning device for dispensing a roll of ribbon or tape in a continuous uniform manner as the roll decreases in size.

2. Description of the Prior Art

As is well known in the art, various problems and difficulties are encountered in providing suitable means for the dispensing of a roll of ribbon or tape material in a continuous manner under uniform tension as the roll decreases in size.

In many industrial and manufacturing plants, ribbons or tape of various materials are required in the fabrication of many products, particularly continuous flexible tubings. Such tubings are formed from rolls of materials that include P.V.C., metalized milar, aluminum foil, titlar, P.V.C. coated fiberglass, etc.

Various means and methods have been provided for continuously producing flexible tubing in endless lengths, such as disclosed in U.S. Pat. Nos. 3,271,064; 3,155,559 and 3,778,327. Apparatuses of this type have a problem of establishing a means for continuously feeding the tape from a roll and through a machine under a uniform tension. The respective spools or rolls of tape are generally provided in a free form so that they are wrapped around a central tubular core, mounted on a spindle, and interposed between a mounting board and a plate in a loose manner, with a separate spring-loaded guide member straddling the spool. Other spring-loaded control members, such as idle rollers, are used to feed the ribbon or tape into tube-forming members.

However, as the roll decreases in size, it has a tendency to increase its rotation, thus causing the tape to feed at an excessive speed, whereby the tape will twist or snap and in turn cause the tubing to be imperfectly formed, or it will jam the machine and cause a shutdown period to occur.

Therefore, the herein-disclosed device has been designed to overcome the above-mentioned existing problems.

SUMMARY OF THE INVENTION

In accordance with the invention claimed, there is disclosed a new and improved means for controlling the feeding of rolled tape or ribbon in a continuous uniform manner when used in the process of manufacturing flexible tubing.

It is, therefore, one object of this invention to provide a device that will control the dispensing of the tape by causing a continuous friction to the spool or roll as it rotates about a given axis.

Another object of the invention is to provide a spring-biased hub mounted and supported by bearings, and which is adjustable to establish a continuous compression laterally on the spool of tape, so as to control the frictional rotation of the spool with respect to the low-frictional sheet disposed on the intermediate resilient base member. This arrangement allows the peripheral edge of the continuous tape to contact the low-frictional surface of the sheet when the flexible plate is not used.

A further object of the invention is to provide a device of this character that includes a thin sheet of metal forming a flexible plate interposed between the surface defined by the spool of tape and the surface of the low-frictional sheet material, whereby the friction will remain uniform throughout the contact area of the tape as it is unreeled.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only:

FIG. 1 is an elevational view of a spool of tape mounted to a base by the present invention, allowing the tape to unreel under a uniform tension and friction;

FIG. 2 is an exploded perspective view of the biased hub unit including the mounting nut, spring, and the related bearing members; and FIG. 3 is an enlarged cross-sectional view taken substantially along line 3—3 of FIG. 1, illustrating the spool or reel of tape being frictionally interposed between the rotatable hub member and the engaging surface of the flexible plate.

DESCRIPTION OF THE PREFERRED EMBODIMENT

Referring more particularly to the drawings by characters of reference, FIG. 1 discloses a spool, generally indicated at 10, formed from a continuous ribbon or tape material 12 which may be further formed in various widths, depending upon the product being manufactured thereby.

As previously mentioned, tapes or ribbons 12 of this character are generally used in forming several types of continuous flexible tubings, sometimes referred to as flexible hose or ducting. Thus, tape 12 is fed into a machine designed to create an indefinite length of flexible tubing; and the machine includes a mandrel upon which tape 12 and a spring wire are together wound and bonded together to form the tubing.

During an operation of this kind, it is necessary to control the unwinding of the spool 10 to prevent an excess amount of tape from being fed into the machine. Thus, a frictional tensioning device is needed, and it is herein generally indicated at 14 and shown mounted to a fixed structure defined by support platform member 16. It should be noted that platform member 16 may be positioned in a vertical or horizontal plane. With reference to FIG. 3, platform 16 is shown in a horizontal plane supporting the frictional tensioning device 14 and the spool of tape 12.

Accordingly, the frictional tensioning device comprises a pliable base means 18 formed preferably from a spongy material, such as a foam rubber, which is affixed to the surface of platform 16. Supported on the exposed surface of the pliable base 18 is a layer of low-frictional material 20 formed from a solid sheet of polytetrafluoroethylene, otherwise known under the trademark "Teflon". This material is well known for its extremely low frictional qualities, the frictional reading being $\mu=0.05-0.1$.

Accordingly, frictional material 20 is also flexible so as to bend and cooperate with whatever form the pliable base might take under compression. In one form of the invention, spool 10 can be directly mounted for frictional engagement with the "Teflon" material. However, the preferred from includes the use of interposing a thin sheet, or plate, of smooth metal 22 between the surface of the "Teflon" sheet 20 and the spool 10. Plate 22 is formed from a very thin sheet of metal (approximately 0.005 inch thickness) so as to conform to the surface 21 defined by the continuous tape or ribbon 12 of spool 10. The surface 21 of spool 10 is very often found to be uneven across the diameter thereof, wherein the uneven condition creates additional frictional problems as the tape is rotating while being dispensed.

Hence, with the use of the thin flexible metal plate 22 in combination with the very-low-friction sheet 20, the friction problem that contributes to the erratic dispensing of tape is obviated. That is, the uneven surface 21 of the spool separates from the metal plate as they both rotate together; and thus there is no frictional engagement between the tape and the plate 22 to cause intermittent releases of the tape to the associated machine (not shown).

In order to mount the spool 10 to the frictional tensioning device, there is provided a biasing means, generally indicated at 25, which comprises a hub member 26 having a circular body 28. The body 28 is formed with an annular shoulder 30 defined by a reduced-diameter boss 32 and a second reduced-diameter boss 34 which, in turn, establishes a second shoulder 35. Thus, the diameter of boss 32 is greater than the diameter of boss 34. The two bosses of different diameters allow for the generally two different sizes of openings formed in known tape spools, each spool being provided with a tubular-core member 36.

As shown in FIG. 3, the core 36 has a diameter adapted to recess boss 32 therein, whereby the core and the inner portion of the spool engage the annular shoulder 30. Hub 26 is further provided with oppositely disposed central recesses 40 which accommodate bearings 42. The bearings 42 are positioned in the respective recesses 40 so as to be positioned on a vertical shaft or mounting pin 44, the pin being affixed to platform 16. Thus, hub member 26 rotates with the unreeling spool 10 about the pin 44.

In order to provide the correct biasing pressure against a given spool or roll of tape, pin 44 is formed having its free end threaded to receive a nut, such as wing nut 45; and a coil spring 46 is interposed between nut 45 and hub member 26. To allow for free rotation of the hub and spool, spring 46 engages the inner runner of the bearing 42. Thus, only a downward pressure is actually created on the hub member itself.

Accordingly, as the spool rotates, the tape or ribbon 12 is evenly unreeled and fed into the cooperating machine under a controlled frictional tension, whereby the tension of the spool will remain constant as the diameter of the spool is reduced.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A frictional tensioning device in combination with a spool of tape or ribbon, to provide a constant frictional tension on said spool as the diameter thereof is reduced during the dispensing of the tape or ribbon, said device comprising:

a spool of tape having a central core on which said tape is coiled;

a fixed structure for mounting said device and said spool;

a resilient base member secured to said fixed structure;

a low-frictional surface formed on or mounted to the surface of said resilient base member, and arranged to frictionally engage the surface of said spool defined by said coiled tape;

a flexible plate interposed between said spool and said low-frictional surface, whereby said spool and said plate are engaged to rotate together about said low-frictional surface; and means for biasingly securing said spool to said fixed structure, to engage said low-frictional surface of said flexible plate under a constantly even pressure.

2. A frictional tensioning device in combination as recited in claim 1, wherein said low-frictional surface is defined by a layer of flexible sheet material.

3. A frictional tensioning device in combination as recited in claim 2, wherein said means for biasingly securing said spool comprises:

a hub member adapted to be received in said central core of said spool, whereby said hub will rotate with said spool;

a fixed pin secured to said fixed structure, said hub member being rotatably mounted thereto; and adjustable biasing means mounted to said pin and adapted to engage said hub member, to provide a controlled biasing frictional pressure of said spool and said flexible plate against said low-frictional surface.

4. A frictional tensioning device in combination as recited in claim 3, wherein said hub member comprises:

at least one reduced-diameter boss defining an annular engaging surface thereon, said boss being received in said central core of said spool; and bearing means mounted in said hub member and adapted to receive said pin therethrough, said adjustable biasing means engaging said bearing means.

5. A frictional tensioning device in combination as recited in claim 4, wherein said bearing means comprises:

a first bearing member disposed in the upper surface of said hub member; and a second bearing member disposed in the lower surface of said hub member, said first and second bearings being axially aligned to receive said pin therethrough.

6. A frictional tensioning device in combination as recited in claim 5, wherein said adjustable biasing means comprises:

a coil spring mounted over said pin to engage said first bearing member; and a nut threadably adjustable on said pin engaging said spring, to control the biasing force of said spring.

7. A frictional tensioning device in combination as recited in claim 6, wherein said low-frictional surface comprises a thin layer of polytetrafluoroethylene material, whereby said plate and said polytetrafluoroethylene material can be adapted to any irregular form created by said surface of said spool of tape.

8. A frictional tensioning device in combination as recited in claim 7, wherein said hub member includes a plurality of contiguous boss members of reduced diameters, to accommodate the various diameters of said central core of said spool.

* * * * *